United States Patent [19]

Nowak et al.

[11] Patent Number: 4,880,252

[45] Date of Patent: Nov. 14, 1989

[54] SKI SAFETY BINDING

[75] Inventors: Gerhard Nowak, Biedermannsdorf; Klaus Kruschik, Gumpoldskirchen; Hans P. Morbitzer, Vienna; Rudolf Theuer, Trumau; Alfred Winter, Vienna, all of Austria

[73] Assignee: TMC Corporation, Baar, Switzerland

[21] Appl. No.: 199,046

[22] PCT Filed: Aug. 12, 1987

[86] PCT No.: PCT/EP87/00443

§ 371 Date: May 2, 1988

§ 102(e) Date: May 2, 1988

[87] PCT Pub. No.: WO88/01191

PCT Pub. Date: Feb. 25, 1988

[30] Foreign Application Priority Data

Aug. 14, 1986 [AT] Austria ..... 2199/86

[51] Int. Cl.[4] ..... A63C 9/081; A63C 9/088

[52] U.S. Cl. ..... 280/618; 280/631

[58] Field of Search ..... 280/612, DIG. 13, 618, 280/626, 631, 632

[56] References Cited

U.S. PATENT DOCUMENTS

| | | | |
|---|---|---|---|
| 3,950,003 | 4/1976 | Korger | 280/618 |
| 4,130,296 | 12/1978 | D'Antonio et al. | 280/618 |
| 4,159,124 | 6/1979 | Salomon | 280/612 |
| 4,291,894 | 9/1981 | D'Antonio et al. | 280/612 |
| 4,415,176 | 11/1983 | Hull et al. | 280/612 |
| 4,494,767 | 1/1985 | Campillo et al. | 280/612 |

FOREIGN PATENT DOCUMENTS

| | | |
|---|---|---|
| 307943 | 6/1973 | Austria . |
| 2519544 | 11/1975 | Fed. Rep. of Germany . |
| 2533337 | 2/1976 | Fed. Rep. of Germany . |
| 2757800 | 7/1978 | Fed. Rep. of Germany . |
| 2737535 | 3/1979 | Fed. Rep. of Germany . |
| 2907939 | 9/1979 | Fed. Rep. of Germany . |
| 3311901 | 10/1984 | Fed. Rep. of Germany . |
| 2375880 | 7/1978 | France . |
| WO84/03841 | 10/1984 | World Int. Prop. O. . |

*Primary Examiner*—Charles A. Marmor
*Assistant Examiner*—Tamara L. Finlay
*Attorney, Agent, or Firm*—Finnegan, Henderson, Farabow, Garrett & Dunner

[57] ABSTRACT

The present invention concerns a ski safety binding including an electronic analyzer connected to force pickups that emit electrical signals. An electric power supply such as a battery is provided. An electromechanical release element controls a locking mechanism for acting on a heel holder or piece. The electromechanical release element has at least one stop member. To assure high reliability even in the severe weather conditions, the present invention mounts the electromechanical release member inside a well sealed housing. A drive control member is positioned in sealed manner through the wall of the housing. The drive control member includes a shaft and controls the locking mechanism that acts on the heel piece.

10 Claims, 8 Drawing Sheets

SKI SAFETY BINDING

The invention relates to a safety ski binding having an electronic interpreter circuit which is connected to load cells that emit electrical signals, an electric power supply, e.g., a battery, and an electromechanical release provided with at least one latch member that drives a control device for controlling a locking mechanism which acts on the heel irons.

A number of proposals for this kind of ski bindings are known. The common feature of these approaches is an open arrangement of the electromechanical release in toe irons, that is to say, the releases remain exposed with little protection from weather-dependent influences. This can easily lead to freezing or dirt collection, so that the operation of such a binding can no longer be properly assured, since it can operate only with relatively small triggering forces so as to minimize power consumption. However, it is impossible with these small triggering forces to break off even small deposits of ice or to overcome a frictional grip of the locking mechanism which is increased by dust collection.

Thus, for example, French Pat. No. 2,375,880 discloses a safety ski binding in which the latch member is formed by a pawl, which is controlled by means of an axially sliding bar driven by an electromagnet. In this ski binding, the electromagnet is mounted in ski irons having an opening in its underside and which is therefore exposed, practically without protection, to penetrating snow. The considerable danger with this approach is that the latch member and the electromagnet may be exposed to frost formation, and thus may barely meet with the safety standards adopted for conditions of normal usage.

Furthermore, Austrian Pat. No. 307,94 also proposes a ski binding in which the latch member is also controlled by an electromagnet. Admittedly, this approach also provides for closed ski irons in which the electromagnet is mounted, but these irons are traversed with considerable play by a number of actuators. This structure allows water to seep through and can in the final analysis lead to freezing and locking of the release.

In the prior art device, the ski boot is held in position by a revolving notch, whereby the shaft for the drive of this notch is mounted in ball bearings, which are not sealed. Moreover, in substantially closed spaces, water may collect as a result of temperature and air pressure variations, since the air moisture, which, as a result of temperature variations that produce corresponding pressure variations in the interior of the ski irons, enters the interior through the smallest slit and condenses therein. This condensation does not flow away readily and therefore, increases the risk of frost formation.

The object of the present invention is to overcome the drawbacks of the conventional structure.

A further object is to provide a ski binding of the kind referred to in the introduction, but which operates reliably even under the difficult conditions prevailing in winter sports.

Another object of the present invention is the placement of the control device such that it is immune from weather conditions. This is achieved by placing the electromechanical release in an enclosure which is sealed all around and by designing the control device as a shaft that is passed in fluid-tight manner through the wall of the enclosure. In this way, the sensitive portion of the binding is fully protected from meteorological influences, particularly from freezing and dust collection. Since the shaft may control a revolving notch or may be formed as such, only small control forces are necessary to move the shaft from the locking position to the unlocking position.

In a further embodiment of the invention, the housing may be filled with a dry inert gas or with an electrically insulating liquid, for instance synthetic oil, remaining fluid to at least −30° C., whereby especially high protection is obtained. Moreover the filling with oil or the like allow reliably detecting any leakage that might degrade the operational reliability.

Regarding a ski safety binding of the invention wherein the electromechanical release member is an electromagnet, a further embodiment of the invention provides this electromagnet with a tipping armature having a stop surface against which rests—in the operational heel piece position—an inner lever mounted inside the housing and prestressed against the unlocked heel piece position. Thereby very small forces easily delivered by the electromagnet will suffice to release the binding. To do so, the electromagnet merely needs to overcome the friction forces acting on this inner stop means. As a result, the force required to release the binding can be kept especially small while simultaneously however large retaining forces can be applied to the heel piece.

Provision furthermore may be made such that the inner lever coming to rest against the stop surface of the tipping armature is irrotationally connected to the shaft acting as control and passing through the housing, this shaft controlling a stop outside the housing or being a stop means itself, for instance in the form of a flat, the inner lever spring-loaded opposite its direction of unlocking, the spring force exerting a torque on the spindle which exceeds the torque caused by the friction forces applied on the spindle by the external snap-in means outside the housing. In practice there results an active switch component which upon triggering by the electromagnet imparts a rotation to the shaft by means of the energy stored in its spring even in the absence of external forces on the shaft.

In order that minute control forces be sufficient in such a binding, provision further may be made that an external prestressed cam-lever can be brought to rest against the stop means controlled by the shaft passing through the housing or being formed by this shaft, the cam lever being prestressed opposite its unlocking position and supporting an outer stop arm on which rests a tensioning spring prestressing an outer stop lever passing over a beak of the heel piece when same is in the operating position and opposite its locked position.

While there might be icing and soiling of the stop means outside the housing, the consequences are not serious because correspondingly high forces are generated and therefore an increase in the retaining forces due to soiling does not entail significant reduction in the reliability of release as the required release force can be assured by correspondingly sizing the spring action on the cam lever cooperating with the stop means.

A further highly advantageous embodiment of a ski binding of the invention is characterized in that the inner lever coming to rest against the stop surface of the tipping armature comprises a clearance entered by an inner stop arm preferably angled or curved at its free end and rigidly joined to the shaft passing through the housing and mounted inside this housing, while an outer stop arm irrotationally connected to the shaft acts as support—in the locked state—for an outer rest lever mounted outside the housing itself providing a rest for a cocking spring prestressing an outer stop lever retaining the heel piece in its locked operating position toward its locked position, this outer stop arm subtending in the ready-to-operate position of the binding an angle slightly larger than 90° with the outer rest lever in order to exert a slight torque opposite the unlocked position of the outer stop arm on this arm and hence on the shaft. Thereby the release triggered by the switch component is actively enhanced by the externally applied forces.

This solution offers the advantage that the spring forces inside the switch-component housing can be kept minute, and springs can be used, which practically allow determining merely a specific position of the individual parts, namely of the tipping armature and of the inner lever with the clearance. Upon releasing the binding only minute forces will therefore be required to reset the individual parts into a position ready for operation and allowing the locking of the binding. It suffices to rotate the outer stop arm connected to the shaft outside the housing, because this arm drives the shaft and thereby the inner stop arm entering the clearance. Once this has been accomplished, the tipping armature can again support on its rest surface the inside lever in view of the weak spring force it is subjected to. In the released state of the binding, the resetting of the outer snap-in arm can be carried out by means of a spring-loaded, upward-pivoting heel-piece with a projection and by means of this projection drives the outer stop arm and moves it into the operative position.

To arbitrarily release the binding of the invention, provision may be made for maintaining a spring-loaded release pin in the housing which is actuated from outside the housing, preferably by means of a membrane and which acts on the release member. Thereby unnecessary battery use when getting out of the binding normally will be prevented.

To achieve a compact design and to avoid long electric cables that can be protected only with difficulty, another feature of the invention provides a chamber at the housing and receiving the analyzing circuit and possibly also the battery. Thereby the electrical wires are protected entirely against ambient effects, in particular soiling, as only feedthroughs for these wires are required.

In that respect it is especially advantageous that the housing is connected to the force pickups and to the binding plate and rests by a sensor with a spherical tip on a support fixed in the ski. This makes it possible to pass the wires to the force pickups also through the housing, whereby they are protected against mechanical damages and shall not be moved when the heel piece is actuated, and therefore cannot break.

The invention is discussed in further detail below in relation to the drawing.

Figure 2:
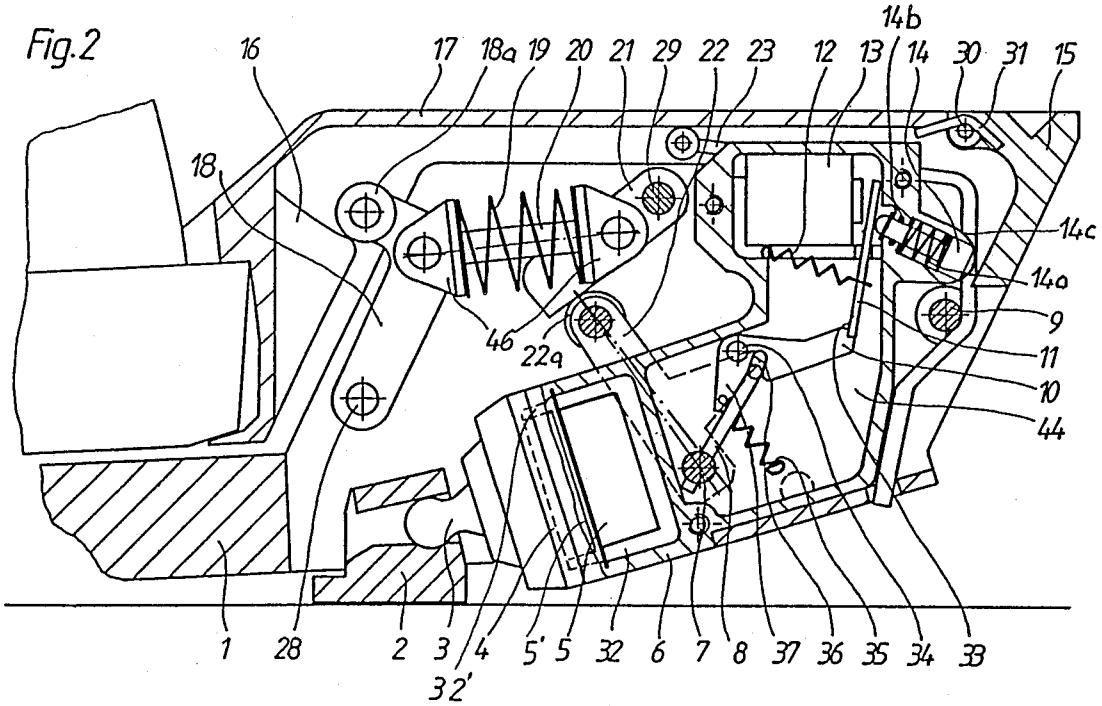
FIG. 2 is a schematic of a first embodiment of a releasable heel piece of the invention in the locked state.
Figure 2A:
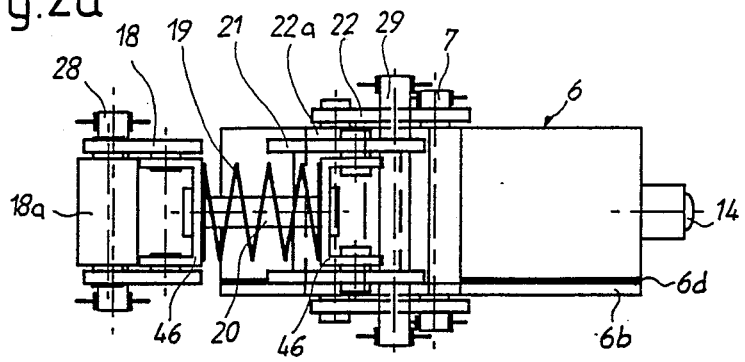
Figure 2B:
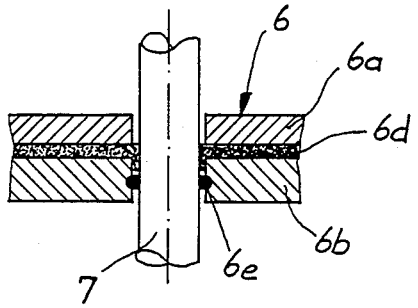
Figure 5A:
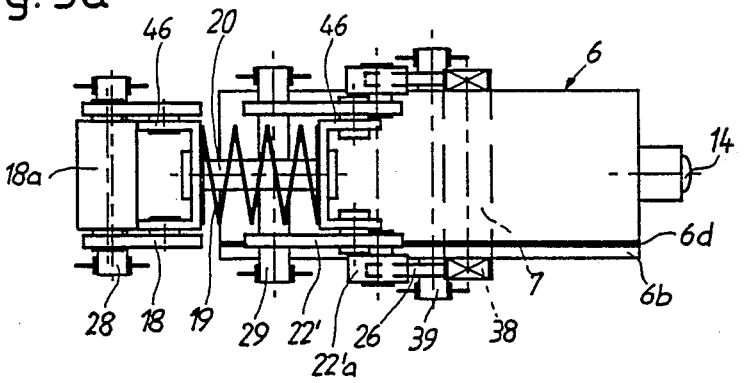
FIG. 5 is a schematic of a further embodiment of a releasable heel piece of the invention in the locked state.
Figure 5:
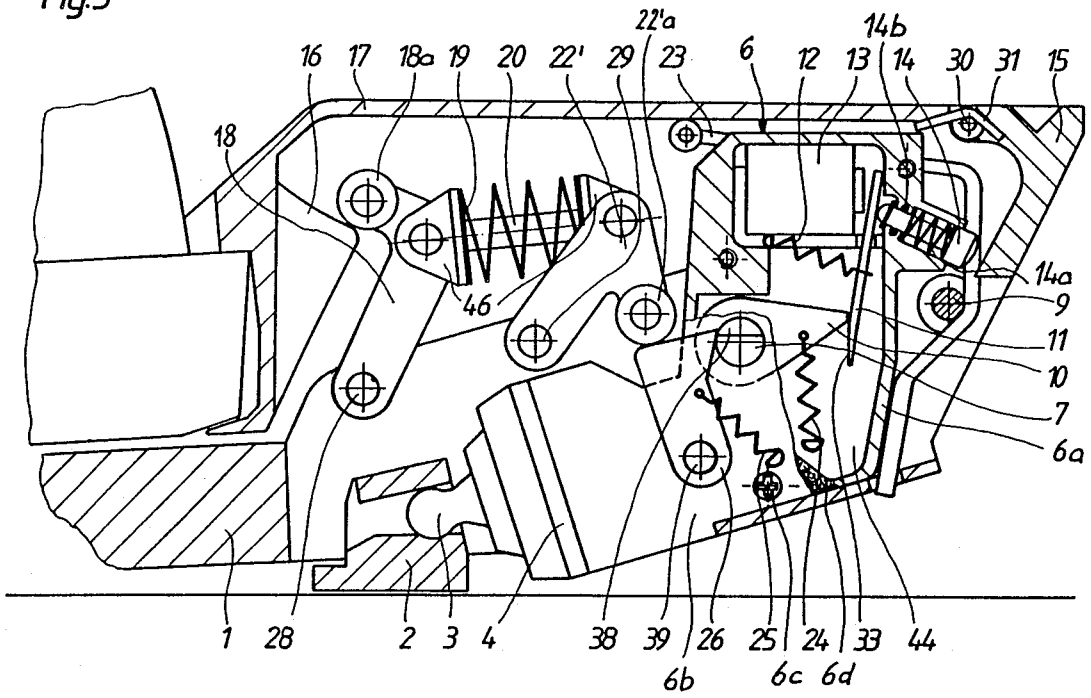

FIGS. 2*a* and 5*a* are partial topviews of FIGS. 2 and 5, resp. and FIG. 2*b* is a pertinent detail.

Figure 1:
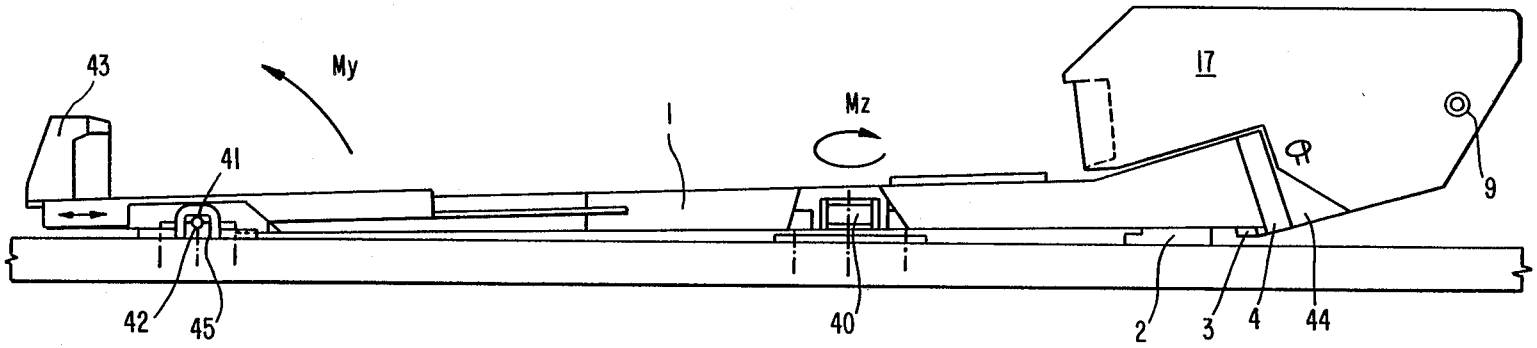
FIG. 1 is a schematic of a binding.

The binding shown in FIG. 1 is a plate binding, the binding plate 1 being rotatable about a spherical pivot 40 mounted at the intersection of the skier's tibia axis and the ski plane and allowing rotating the binding plate in the plane of the skis. At its fore the binding plate 1 comprises a spindle 41 passing through a slot 42 extending in the longitudinal ski direction and located in a ski-fixed fastener 45 entering with large play on all sides a clearance in the underside of the binding plate 1, making possible restricted rotation of the binding plate about the pivot 40 and upward rotation of the binding plate 1 about the spindle 41.

Also, a rigid, non-exchangeable toe piece 43 is held at the fore of the binding plate in clampable and adjustable manner.

The releasable heel piece 17 mounted in the rear of the binding plate 1 is connected to it and can rotate upward about the pin 9 held in an upwardly projecting rib of the binding plate 1. The binding plate 1 furthermore is rigidly fastened at its rear to a switch component 44 resting by means of a force pickup 4 and a measuring element 3 with a spherical end on a ski-fixed bearing 2.

Thereby the binding plate 1 is essentially fixed in its position, however it may move to the extent of the measuring excursions of the force pickups 4 which because of the fixed centers of rotation of the binding plate about the pivot 40 and the spindle 41 allow determining the torques $\pm Mz$ and $\pm My$ acting on the binding plate.

Those features will be described first which are common to both embodiment modes of the releasable heel pieces 17. Those parts belonging to the heel locking mechanism and mounted inside the housing 6 of the switch component 44 always shall be denoted as the inner parts and those outside this housing 6 and belonging to the locking mechanism shall be denoted as the outer parts.

In both embodiment modes of the invention, the housing 6 of the switch component 44 is impermeably sealed all around. The individual FIGS. 2 through 4 and 5 through 7 always show three screws 6*c* fastening a side cover wall 6*b* to the housing 6. The cover wall 6*b* sits on a sealing ring and a groove against a sealing rib of the housing 6 in manner known per se and therefore omitted from this text.

Because the cover wall 6*b* is mounted on the side of the housing 6, this housing is easily accessible for assembly purposes, and furthermore bearing sites may be provided without boring through the side wall 6*a* and/or the cover wall 6*b* of the housing 6 with ensuing sealing. The details of the required sealing is discussed further below.

The housing 6 may consist of a plastic, for instance a polyamide or polyacetal suited for sealing. Advantageously however the housing 6 shall be made of a lightweight metal, for instance of an aluminum or magnesium alloy in order to also prevent water from condensing. Any water of condensation might cause undesired icing inside the housing 6 that may degrade the problem-free operation of the locking mechanism.

Figure 3:
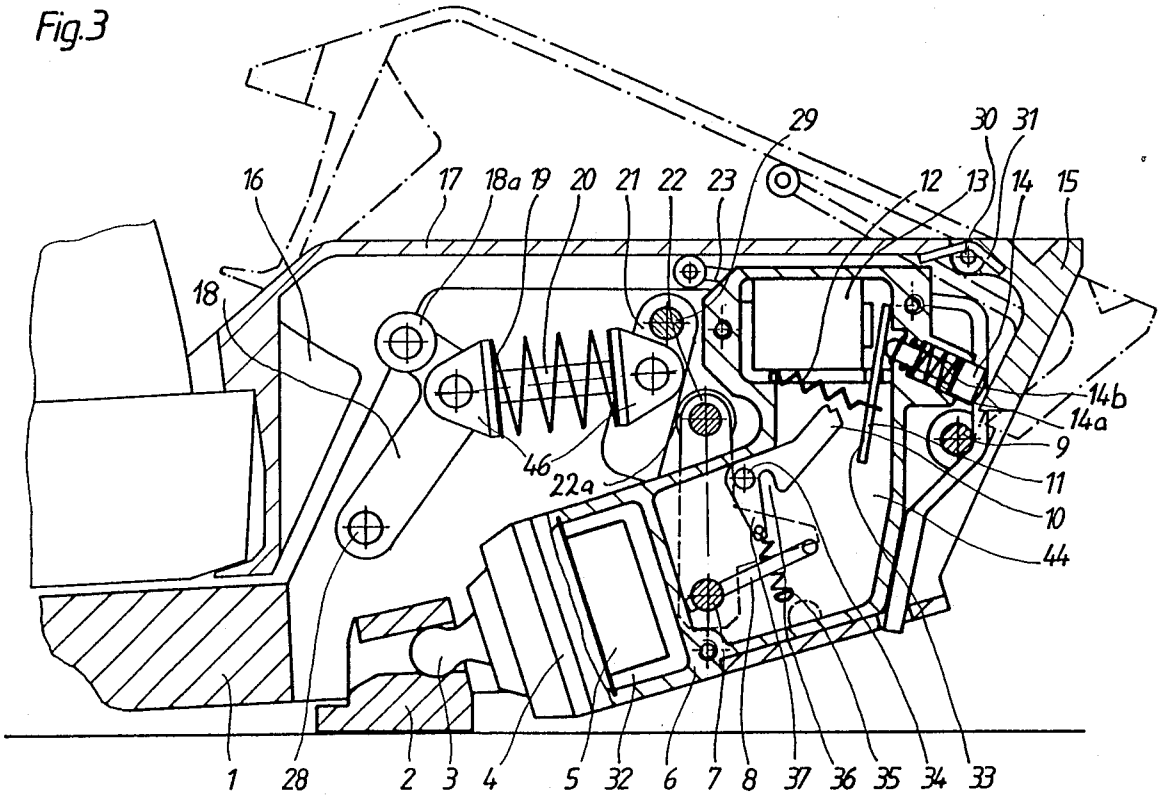
FIG. 3 is the heel piece of FIG. 2 in the released state.
Figure 4:
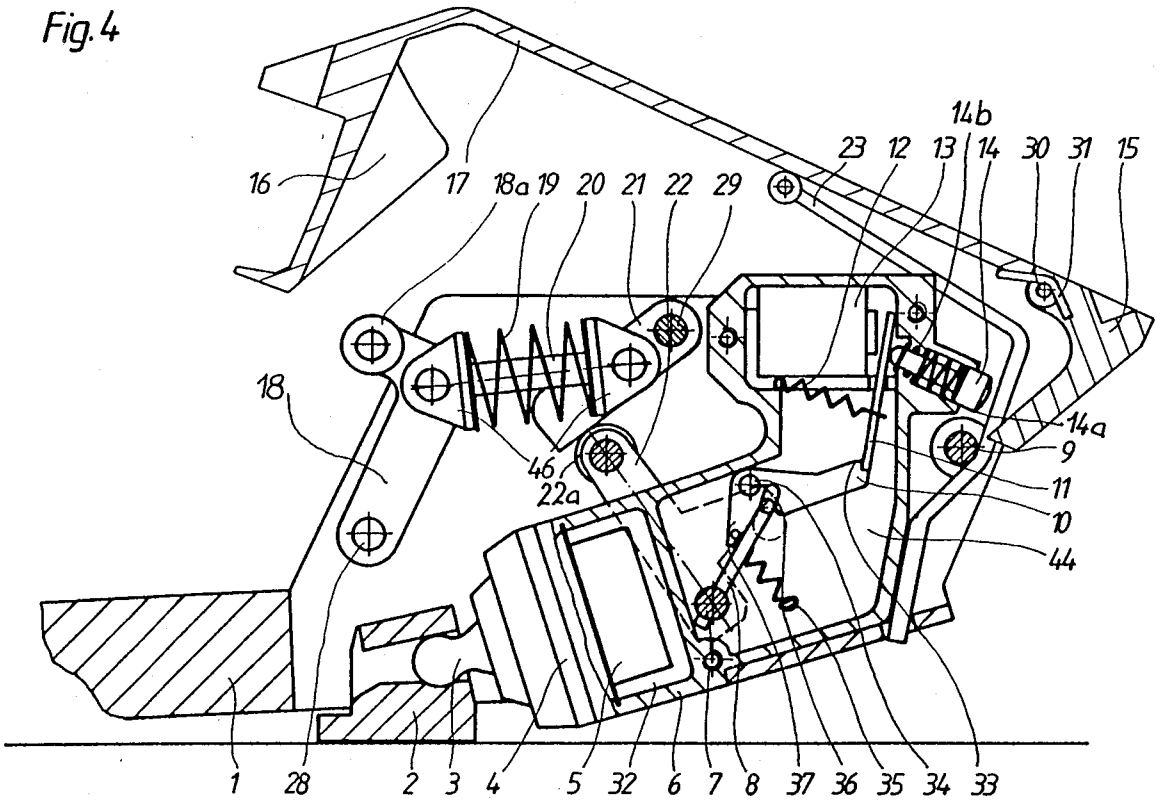
FIG. 4 is heel piece of FIGS. 2 and 3 in the unlocked state ready for boarding.
Figure 6:
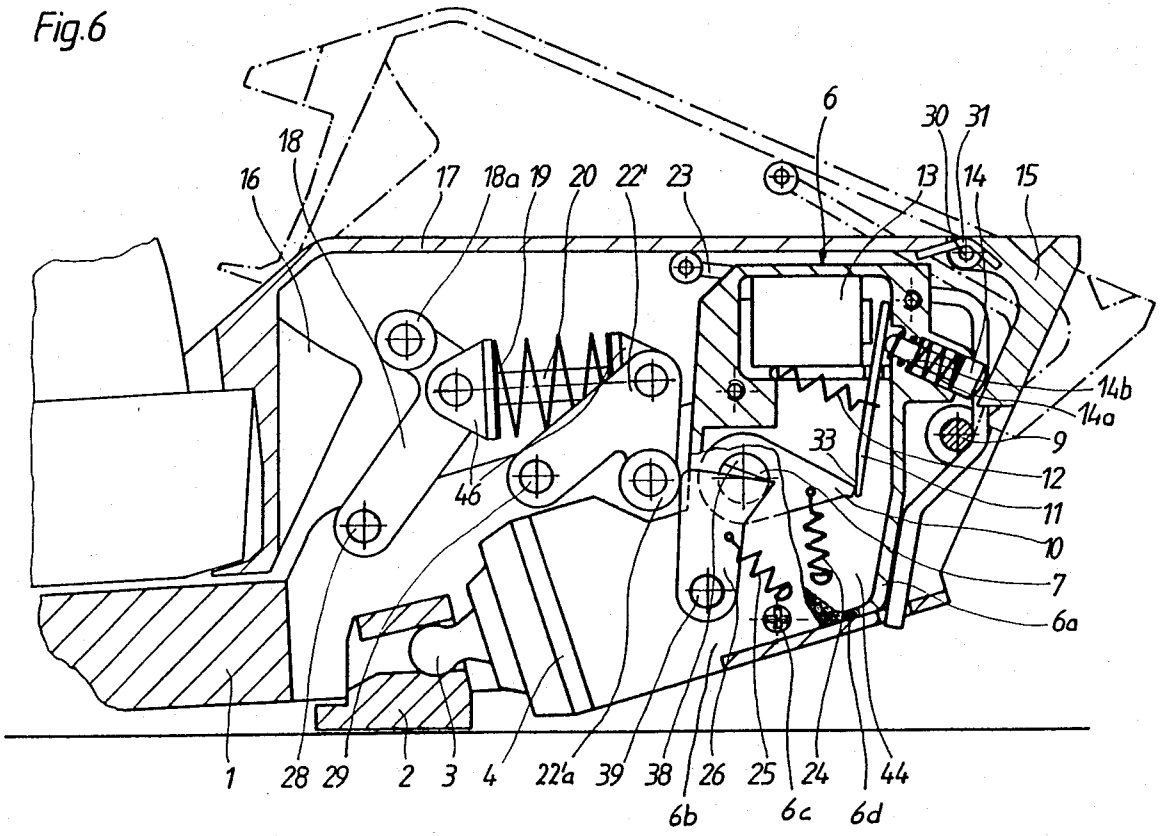
FIG. 6 is the heel piece of FIG. 5 in the released state.
Figure 7:
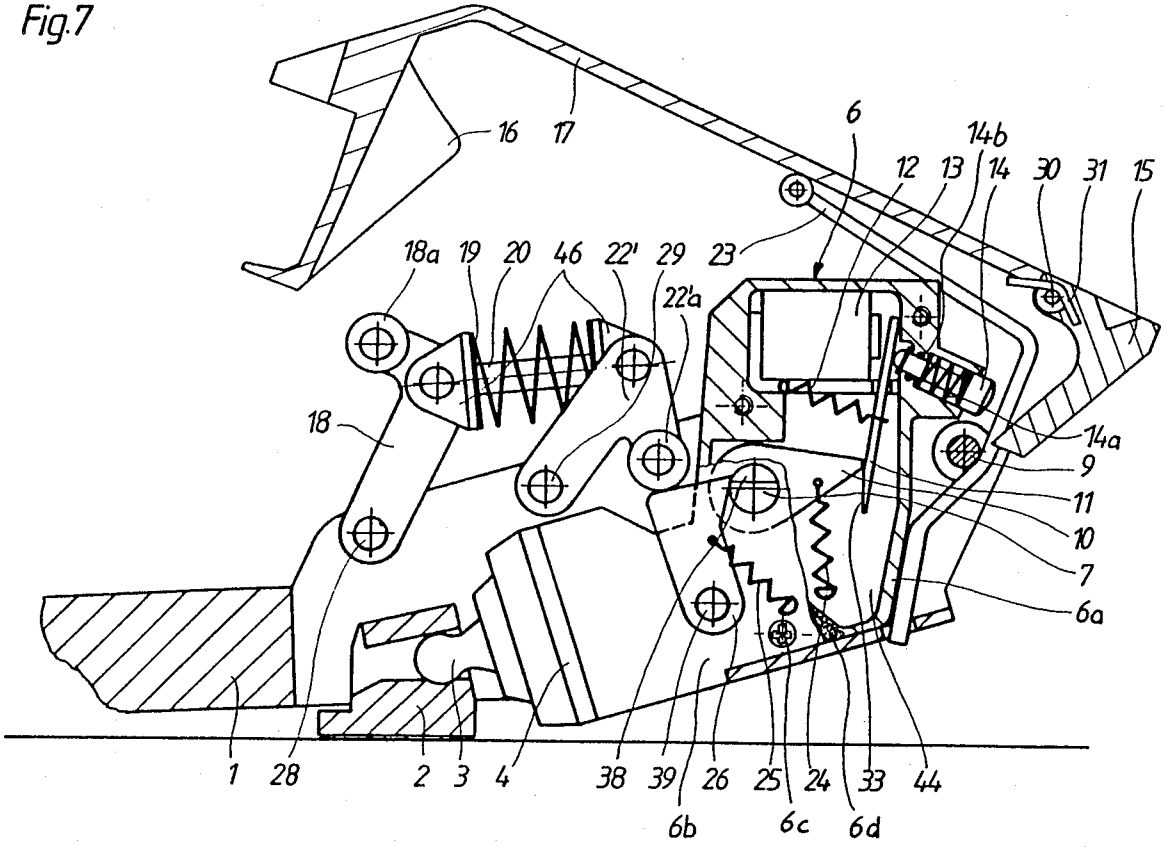
FIG. 7 is the heel piece of FIGS. 5 and 6 in the unlocked state ready for boarding.

In both embodiments the heel piece 17 is provided with a conventional pivot spring 23 for upward rotation which rests on the binding plate 1 and the heel piece 17 and prestressing this heel piece toward its upwardly pivoted end position shown in dashed lines in FIGS. 3 and 6 and in solid lines in FIGS. 4 and 7.

The heel piece 17 comprises a stop beak 16 projecting toward the inside of the heel piece and overlapped in the locked binding position by a roller 18*a* of an outer stop lever 18. This outer stop lever 18 is pivotably held on a pivot pin 28 which in turn is fixed to that part of the heel piece 17 solidly joined to the binding. A coupling rod 20 is linked to the outer stop lever 18 which it connects with a outer rest lever 21 pivotable about a further pivot pin 29 rigidly joined to the binding plate and to be further discussed later, the coupling rod 20 being held with substantial play on rests 46 of a cocking spring 19 linking both parts and in displaceable manner along its longitudinal direction. The rests 21 and 22 are of different designs in the embodiment modes shown but in both cases their function is the same; they shall be further discussed in relation to the particular embodiments.

The cocking spring 19 acts between the parts connected by the coupling rod 20 and forces apart these two parts. Thereby the outer stop lever 18 will be pressed against the stop break 16 when the rest is supported and thereby the heel piece 17 will be prevented from swinging upward.

A manual release knob 15 is pivotably supported by a pin 30 in the heel piece 17 and is prestressed by a spring 31 against its inactive position. When the release knob 15 is pressed, it pivots clockwise, i.e. against the force of the spring 31 and presses the release pin 14 held in a passage in the housing 6 and prestressed by a spring 14*a* toward its inactive position shown in the Figures. This release pin 14 is sealed by an O-ring 14*b* relative to housing 6 in the embodiments shown, though it is also possible to seal it by a membrane 14*c* tightened over the free end of the release pin or being part of the housing and against which the release knob 15 may come to rest.

A measuring element 3 rests on the ski-fixed bearing 2 by means of ball-joint type of seat. This measuring element 3 comprises a force pickup 4 converting the torques ±My and ±Mz applied to the binding plate 1 about its axis of rotations into electrical signals. These force pickups 4 may be for instance piezoelectric transducers or strain gauges or the like and are connected to the housing 6 of the switch component 4 receiving the battery, the analyzing circuit 5, also an electromechanical release element—for instance an electromagnet in the embodiments shown—and parts of the mechanical locking system of the binding. Be it borne in mind as regards the release element that it may also be formed by other components such as a piezoelectric transducer for instance.

Chamber 32' receives the battery 5'. The chamber 32 receives the electronic analyzer 5. Chamber 32' is assembled to the housing 6 of the switch component 44 or consists of parts of the housing. In both the embodiments shown of a binding of the invention, the electromechanical release elements consist of an electromagnet 13 with a tipping armature 11 and connected by (omitted) wires to the analyzer 5 and to the battery. The tipping armature 11 in both embodiments is prestressed by a weak return-spring 12 opposite its position away from the core and comprises a stop surface 33 against which part of the locking mechanism of the heel pieces 17 may be moved to rest.

In the embodiment mode of FIGS. 2 through 4, a pawl-shaped inner lever 10 rests against the dropped-off armature 11 in the ready-to-operate condition of the binding. This inner lever 10 is pivotable about a pin 34 fixed in the housing 6 and is prestressed by a weak spring 35 toward its unlocked position. This inner lever 10 comprises an edge-recess 36. This recess is entered by the angled end of the inner stop arm 8 which also may be designed in arcuate form like a bail and which is irrotationally connected to a shaft 7 passing in sealed manner through the housing 6.

An outer stop arm 22 is mounted irrotationally to this shaft 7 outside the housing 6 and is in the form of a roller lever to achieve low friction. In the operation-ready condition of the binding, this outer stop arm 22 supports an outer rest lever 21 designed as a rest member, which is pivotable about the pivot pin 29 and rigidly connected to the binding plate 1, said rest member acting as a support for the cocking spring 19 that, as already discussed, presses the outer stop lever 18 against the stop beak 16 of the heel piece 17.

As indicated by the dash-dot lines of FIG. 2, the outer rest lever 21 is supported in such a manner by the outer stop arm 22 that it subtends with this outer stop arm 22 an angle slightly in excess of 90° to exert a torque on the outer stop arm 22 which thereby is pre-stressed against its unlocked position. This torque is absorbed by the inner stop arm 8 entering the clearance 36 of the inner lever 10 and by this inner lever 10 which in turn is supported by a first stp means formed by the stop surface 33 of the tipping armature 11.

If now the release pin 14 is forced, by the actuation of the release knob 15, against the tipping armature 11, or if the electromagnet 13 attracts the armature 11, requiring only slight forces in view of the weak return spring 12 and of the lever ratios and the stop support means, then the inner lever 10 loses its support and the torque acting on the outer stop arm 22 rotates the inner stop arm 8 out of the edge recess or clearance 36 so that the inner top arm 8 loses its support. Thereby the outer rest lever 21 can now rotate into the position shown in FIG. 3, as a result of which the roller 18*a* of the external outer stop 18 no longer presses against stop beak 16 of the heel piece 17 which thereupon can swing upward following the release of the sole by the external forces acting on this sole.

When the heel piece 17 swings up, (omitted) projection of this piece comes to rest against another projection, also omitted for the sake of clarity, of the outer stop arm 22 which thereby is rotated into its operational position shown in FIGS. 2 and 4, the projection of the outer stop arm 22 extending to its right. This reset rotation of the outer stop arm 22 causes, by means of the shaft 7, also a reset rotation of the inner stop arm 8 which thereby comes to rest against the beak 37 of the inner lever 10 that then is also rotated back. As a result, this inner lever 10 again comes to rest against the stop surface 33 of the tipping armature 11 after this armature, following its release from the electromagnet 13, was briefly deflected from its rest position, the inner lever 10 sweeping over a ramp of the tipping armature 11. As a result the heel piece again is in its boarding condition.

This reset rotation requires only little force because the cocking spring 19 acts only on the parts 18, 21 connected by the coupling rod 20, with which it forms a closed system. In the ensuing pressure on the heel piece 17, its stop beak 16 presses over the stop lever 18, the cocking spring 19 being compressed. Thereby the heel piece 17 is locked again.

The embodiment mode of FIGS. 5 through 7 differs essentially from that of FIGS. 2 through 4 in that sufficiently strong springs are mounted inside the housing 6 of the switch component 44 so that—in the case of unlocking due to attraction by the electromagnet 13 or by actuation of the release pin 14 through the release knob 15—these springs shall rotate the shaft 7 acting as a control member even in the absence of external loads.

In the embodiment of FIGS. 5 through 7, the tipping armature 11 also comprises a stop surface 33 against which an inner lever 1 is resting in the operation-ready state of the heel piece 17, this lever 10 being irrotiationally fastened to the shaft 7. An inner release spring 24 acts on this inner lever 10 and is strong enough to assure its rotation even in the presence of forces applied outside the housing 6 and hampering rotation.

As already discussed in relation to FIGS. 2 through 4, the shaft 7 passes in sealed manner through the housing 6; however, in the embodiment of FIGS. 5 through 7, it comprises a flat 38 outside the housing 6 and acting as a rotary detent.

This stop on shaft 7 cooperates with an external cam lever 26 acted on by an external release spring 25. This external cam lever 26 is pivotable about the pin 39 rigidly jointed to the binding plate 1 and held in the part of the heel piece fixed to the binding and supports an outer stop arm 22' by its roller **22*a'* acting as a rest member when the heel piece is in the operating condition. This outer stop arm 22' is pivotable about the rotation pin 29 and is connected by the coupling rod 20 to the outer stop lever 18. The outer stop arm 22 in the same manner as the outer stop lever 21 of FIGS. 2 through 4 represents the rest member cited in the description of the common features of the two embodiment modes, said rest member being connected by the coupling rod 20 to the external stop lever 18**.

If by means of a short-term energization of the electromagnet 13 or by actuation of the release know 15, i.e. of the release pin 14, the topping armature 11 is moved toward the electromagnet 13, then the inner lever 10 will rotate on account of the prestressing by the release spring 24. Thereby the shaft 7 also rotates. As a result, the outer cam lever 26 resting on the shaft 7 which by its flat 38 acts as a second stop means loses its rest and rotates also. Accordingly the outer stop arm 22' connected by the coupling rod 20 to the outer stop lever 18 and forming a closed system with the cocking spring 19 and lacking support from the outer stop lever 18 may now escape to the right, whereby the heel piece 17 can swing upward. In this process the individual parts of the locking mechanism, especially the inner lever 10, the external cam lever 26, the outer stop arm 22' and the outer stop lever 18 assume the positions shown in FIG. 6.

The resetting of the binding into the boarding-ready state also takes place while the heel piece 17 swings upward, where this heel piece is provided with corresponding projections (omitted for the sake of clarity), that cooperate with further omitted projections of the shaft 7, of the outer cam lever 26 and of the outer stop arm 22' or of the outer stop lever 18 and which drive these parts along while the upward swing takes place.

In the same manner as for the embodiment of FIGS. 2 through 4, when the heel piece 17 thereafter is pressed, the outer stop lever 18 is pressed so as to overcome the force of the cocking spring 19.

FIGS. **2*a* and 5*a* furthermore show the arrangement of the individual parts of the locking mechanism in topview. For that reason the heel pieces is omitted from these Figures. FIG. 2*b* is an enlarged detail of FIGS. 2*a* or 5*a* and shows especially clearly the sealed passage for the shaft 7 in the individual walls 6*a*, 6*b* of the housing 6. A double seal is provided, namely a rubber seal with lips 6*d* and an O-ring 6*e***. The design of such seals and their assembly is sufficiently known to the expert to require no further discussion.

We claim:

1. A ski binding for a ski with an electronic analyzer connected to force pickups emitting electrical signals, a power supply, for instance a battery, and an electromechanical release member including at least one stop means for releasably engaging a control member for controlling a locking mechanism for restraining a heel piece, comprising:

a closed housing having a wall and supporting the electromechanical release member, the control member including a shaft passing through said wall of said closed housing and said shaft being insulated from outside weather conditions by a seal means.

2. The ski safety binding as defined in claim 1, wherein:

said closed housing is filled with an electrically insulating liquid fluid to at least −30° C., such as a synthetic oil.

3. The ski binding as defined in claim 1, wherein:

said closed housing is filled with a dry inert gas.

4. The ski binding as defined in claim 1 wherein:

a ski-fixed bearing is disposed on the ski for receiving a measuring element, said measuring element including a force pickup connected to said housing for converting torque forces resulting from skiing into electrical signals.

5. The ski binding as defined in claim 4, wherein:

a second stop means disposed outside said closed housing functions as rest for releasably supporting an outer cam lever which is prestressed toward said unlocked position, wherein the heel piece is released from restraining a ski boot and said second stop means forming a bearing for a first outer stop arm supporting a cocking spring, said cocking spring prestressing a second outer stop lever toward said locked position to cause said second outer stop lever to overlap a snap-in beak provided on the heel piece top restrain a ski boot positioned on the ski binding.

6. The ski binding as defined in claim 1, wherein:

the electromechanical release member includes an electromagnet and a tipping armature having a first stop surface, an inner lever disposed inside said closed housing surface for releasably securing the heel piece in a locked position for restraining a ski boot, said inner lever supported by said first stop surface during said locked position, said inner lever being prestressed toward an unlocked position wherein the heel piece is released from restraining a ski boot.

7. The ski binding as defined in claim 6, comprising:

said inner lever having a clearance for receiving a first inner stop arm, said first inner stop arm being angled at its free end and irrationally fastened to said shaft, a first outer stop arm disposed outside said closed housing being irrationally fastened to said shaft and in said locked position supporting an outer rest lever mounted outside said closed housing and serving as a rest for a cocking spring, said cocking spring prestressing an outer stop lever toward said locked position, said first outer stop arm subtending with the outer lever at an angle slightly exceeding 90° in said locked position in order to exert a slight torque to stress said first outer stop arm toward said unlocked position and on said shaft.

8. The ski binding as defined in one of claim 6, wherein:

a spring-loaded release pin may be pushed against said tipping armature to remove the support of said inner lever and pivotably mounted in said closed housing and operable from outside said closed housing to contact said tipping armature to prevent contact with said inner lever, said release pin having an outer free end, said outer free end being preferably covered by a membrane.

9. The ski binding as defined in claim 6, wherein said shaft includes a second stop means arranged outside said housing, said second stop means releasably supporting an external lever for controlling the positioning of the heel piece and said inner inner lever being prestressed by a spring toward the unlocked position whereby the torque exerted on said shaft exceeds the torque resulting from the friction generated from said second stop means against said shaft.

10. The ski binding as defined in one of claims 1, 3, 5 or 8, wherein:

a chamber mounted to said closed housing may contain the analyzing circuit and also the battery.

* * * * *

UNITED STATES PATENT AND TRADEMARK OFFICE

CERTIFICATE OF CORRECTION

PATENT NO. : 4,880,252

DATED : November 14, 1989

INVENTOR(S) : GERHARD NOWAK ET AL

It is certified that error appears in the above-identified patent and that said Letters Patent is hereby corrected as shown below:

Claim 8, column 9, line 3, change "in one of claim 6" to --in claim 6--.

Signed and Sealed this

Seventeenth Day of December, 1991

*Attest:*

HARRY F. MANBECK, JR.

*Attesting Officer*

*Commissioner of Patents and Trademarks*